US005326274A

United States Patent [19]

Pfaff et al.

[11] Patent Number: 5,326,274

[45] Date of Patent: Jul. 5, 1994

[54] ELECTRICAL CONNECTOR

[75] Inventors: Matthias Pfaff, Offenbach; Guido G. M. P. van de Burgt, Darmstadt, both of Fed. Rep. of Germany

[73] Assignee: The Whitaker Corporation, Wilmington, Del.

[21] Appl. No.: 86,486

[22] Filed: Jul. 1, 1993

[30] Foreign Application Priority Data

Jul. 8, 1992 [GB] United Kingdom ..... 9214525

[51] Int. Cl.[5] ..... H01R 13/00

[52] U.S. Cl. ..... 439/157

[58] Field of Search ..... 439/152-160

[56] References Cited

U.S. PATENT DOCUMENTS 5,207,598 5/1993 Yamada et al. ..... 439/157

5,263,871 11/1993 Sano ..... 439/157

*Primary Examiner*—Joseph H. McGlyn

*Attorney, Agent, or Firm*—Eric J. Groen

[57] ABSTRACT

An electrical connector having a housing comprising a first elongated slot and a second elongated slot for receiving a generally U-shaped latch camming slide. A first resilient latch and a second resilient latch are associated with the first and second elongated slots and, respectively, and they become deflected into the slots and when a locking insert is mounted on the housing, thereby locking the generally U-shaped latch camming slide in housing.

11 Claims, 6 Drawing Sheets

ELECTRICAL CONNECTOR

BACKGROUND OF THE INVENTION

1. Field of the Invention

This invention relates to an electrical connector, and more particularly, it relates to an electrical connector having a latch camming slide in the electrical connector.

2. Description of the Prior Art

In the past, some electrical connectors had a latch camming slide which was used to latch the connector to a mating connector under a camming action. For example, German Patent DE 3845179 C2, teaches of this camming Slide concept, and as shown in FIG., a camming slide 8 having camming guides 88, 82 cooperate with plugs 80 on complementary connector 6 to pull or cam the complementary connector 6 into mating engagement with the connector 20. In the past, the camming slide 8 was retained in the connector by providing barbs, such as barbs 106 in FIG. 1 of Klunker, which cooperate with the housing of the connector to retain the camming slide 8 in the housing.

A disadvantage of this design is that the latch camming slide can be easily pulled out of the housing. In addition, when the latch camming slide is in a retracted position (for example, when the posts of the complementary connector 6 are being inserted into the camming grooves in the camming slide 8), the latch camming slide had a tendency to get caught on wiring which, in turn, caused the camming slide to be pulled out of the housing.

SUMMARY OF THE INVENTION

An object of this invention is to provide an electrical connector having improved means for retaining a latch camming slide in the connector housing.

Another object of this invention is to provide an electrical connector which is designed so that a latch camming slide can be slid into and out of the housing, but which becomes locked in the housing after a locking insert is mounted onto the housing.

Yet another object of this invention is to provide a first resilient latch and a second resilient latch which are integrally formed as part of the housing and which are deflected into a first elongated slot and a second elongated slot, respectively, when a locking insert is mounted onto the housing, thereby causing the latch camming slide to be slidably retained in the housing.

In one aspect of the invention, this invention comprises a connector comprising a housing comprising a first elongated slot and a second elongated slot, said housing also comprising a wall defining an aperture, a first resilient latch associated with said first elongated slot and said aperture, and a second resilient latch associated with said second elongated slot and said aperture; a generally U-shaped latch camming slide having a first leg portion, a second leg portion and a joining portion joining said first and second leg portions, said first and second leg portions being received in said first and second elongated slots, respectively, so that said generally U-shaped latch camming slide can slide in and out of said housing, each of said first and second resilient detents having a shoulder notch; and a locking insert for mounting in said aperture in order to bias said first and second resilient latches into said first and second elongated slots so that said shoulder notches of said first and second resilient detents engage said first and second resilient latches, respectively, thereby locking said generally U-shaped latch camming slide in said housing.

DETAILED DESCRIPTION OF THE PREFERRED EMBODIMENT

Figure 1:
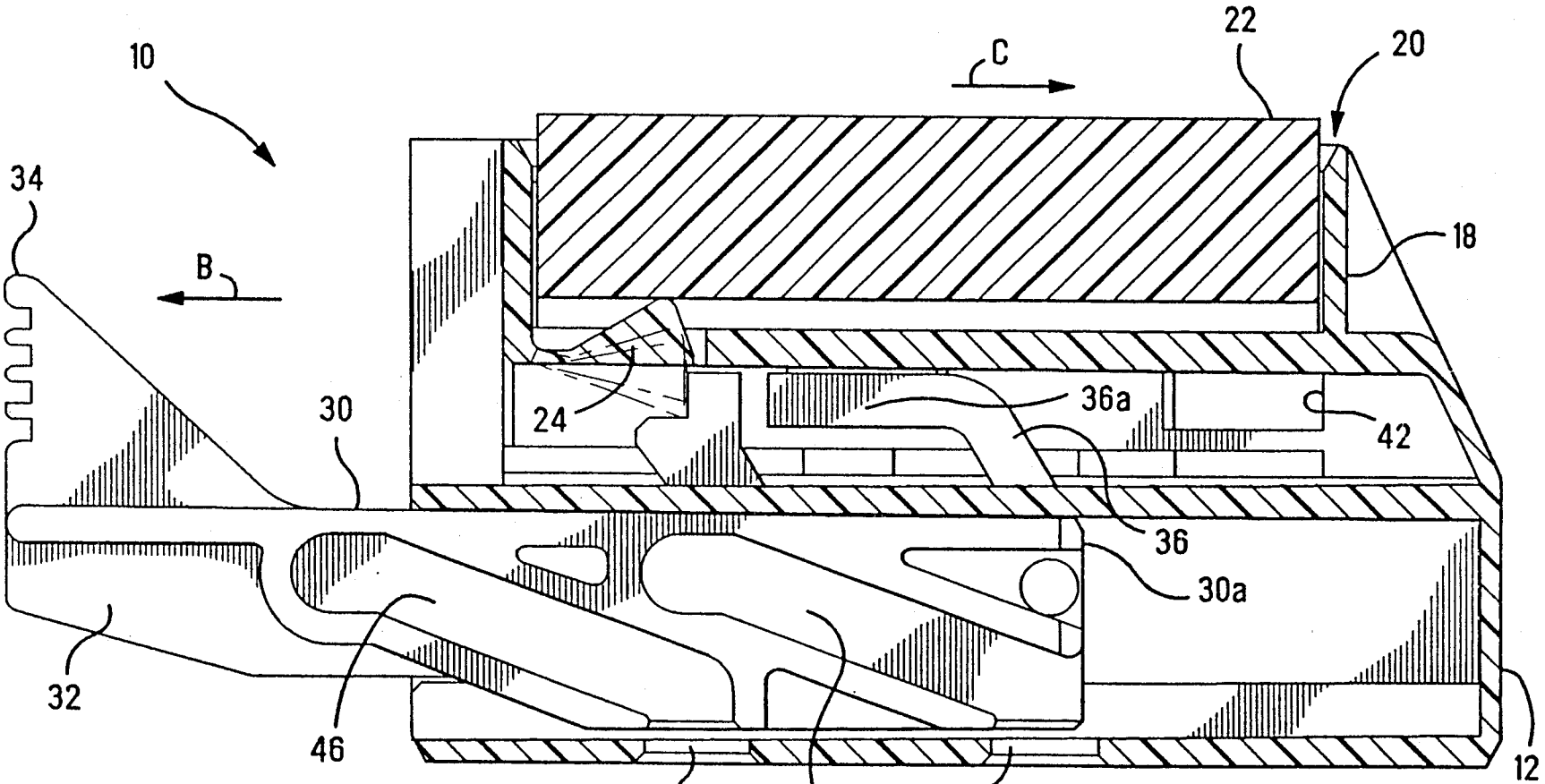
FIG. 1 is an assembled view of an electrical connector showing a locking insert engaging a resilient latch before the resilient latch is deflected into the path of a camming slide.
Figure 3:
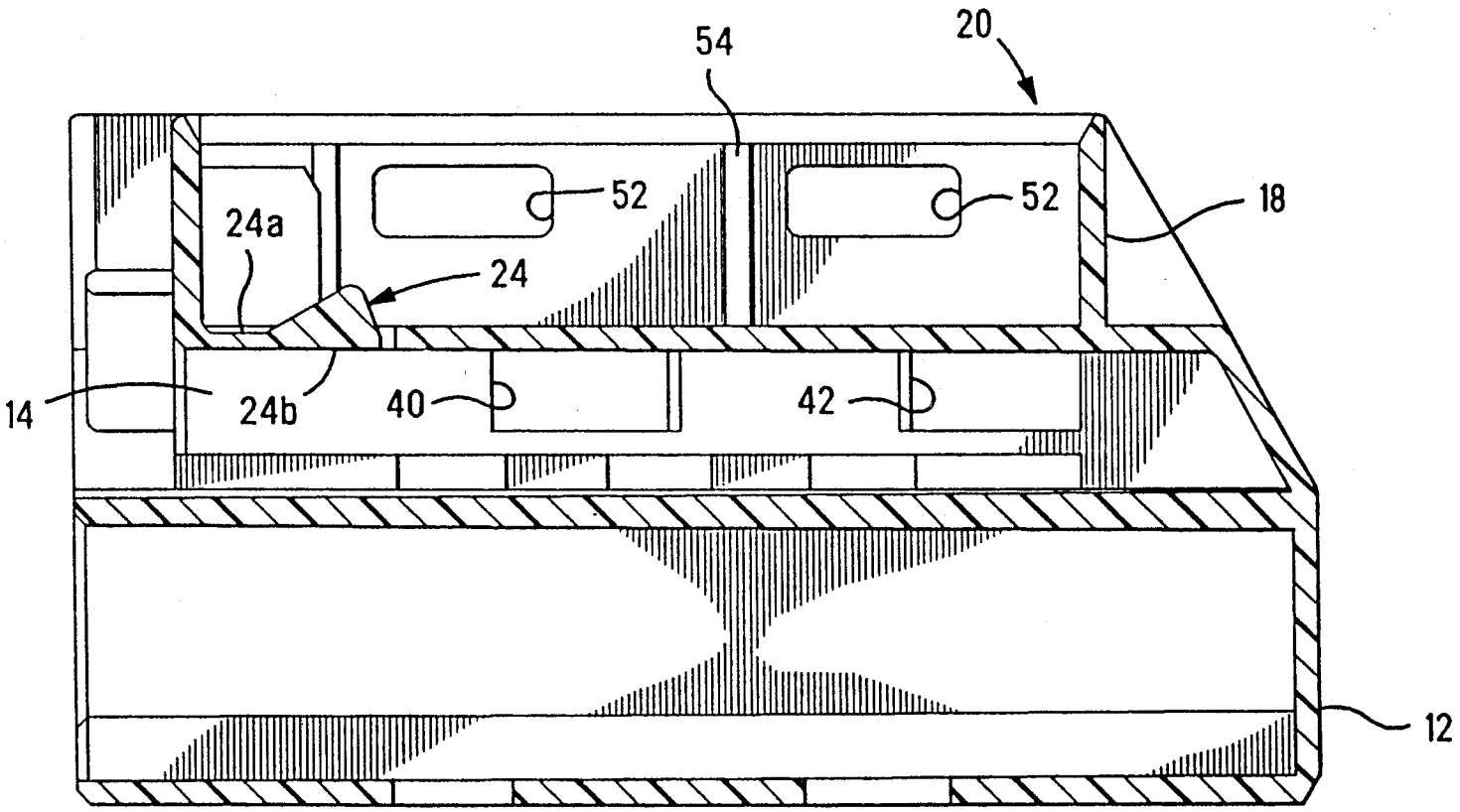
FIG. 3 shows a longitudinal cross-section of the housing showing one of the elongated tracks in the housing.
Figure 4:
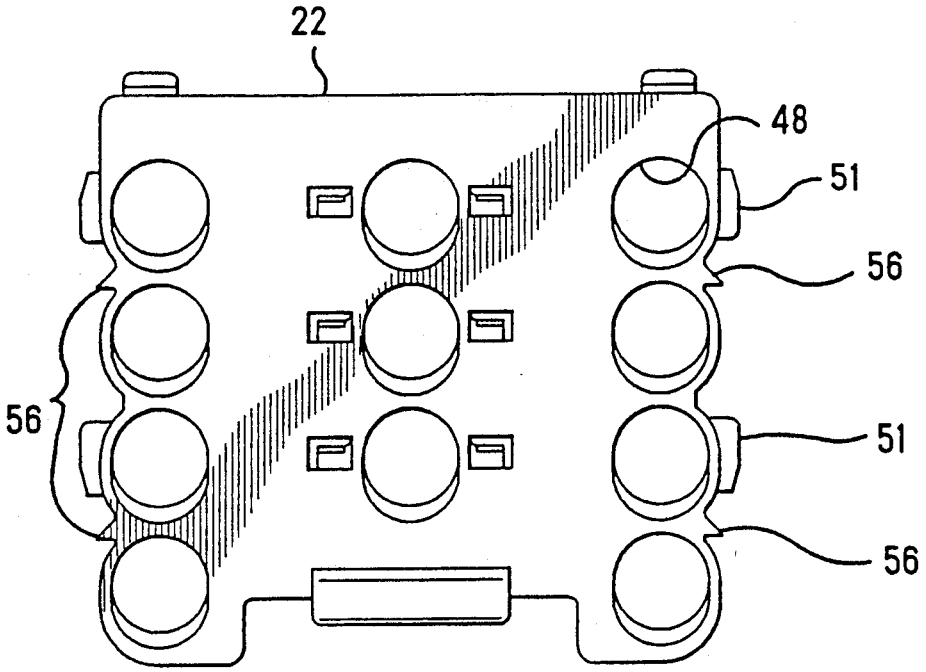
FIG. 4 is a top plan view of the locking insert shown in FIG. 1.
Figure 6:
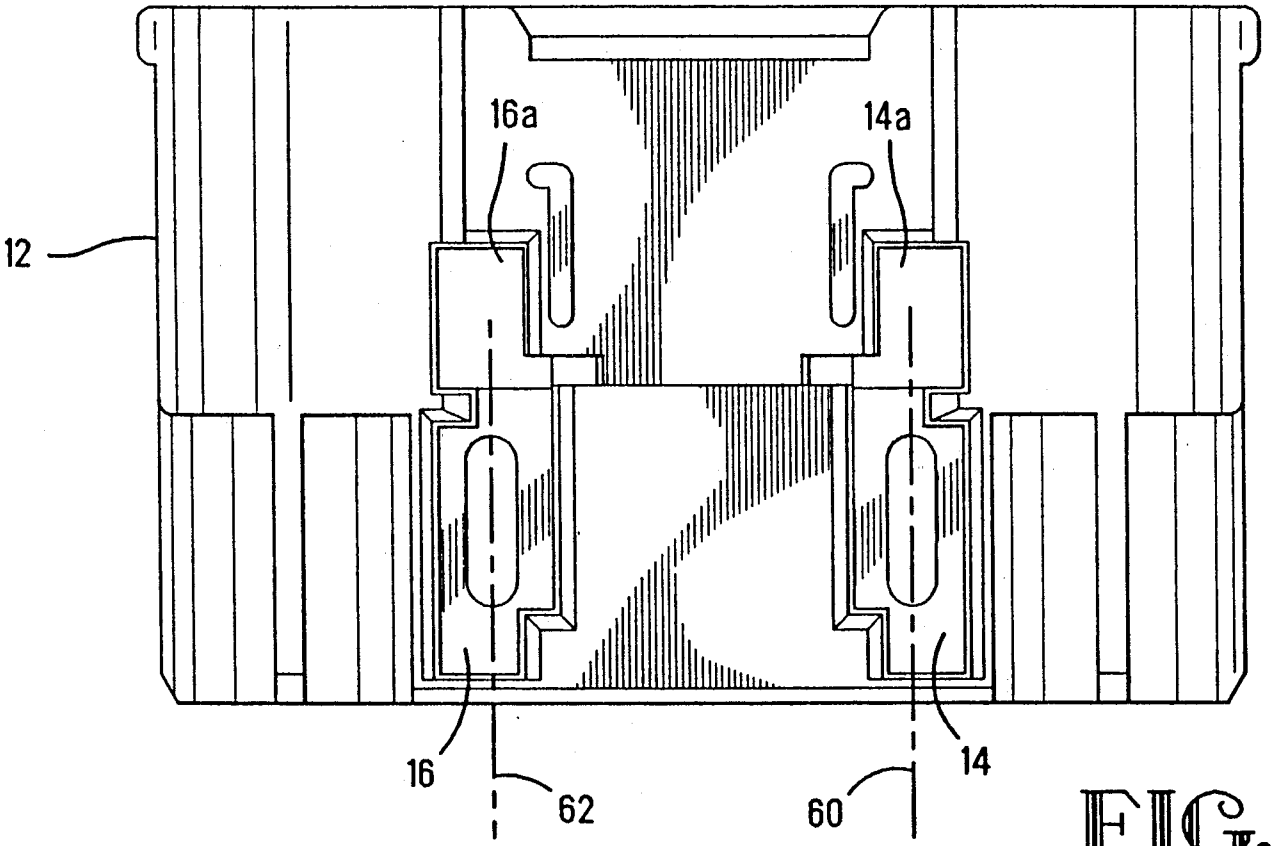
FIG. 6 is a view of the housing body, taken in the direction of arrow A in FIG. 5 showing a first elongated slot or opening and a second elongated slot which receive a first leg and a second leg, respectively, of the latch camming slide.

Referring now to FIG. 1, an assembled view of an electrical connector, hereinafter designated electrical connector 10, is shown. The electrical connector 10 comprises a housing 12 having a first elongated slot 14 (FIGS. 6 and 7) and a second elongated slot 16 extending longitudinally through housing 12. Notice that the first and second elongated slots 14 and 16 have an insert end 14*a* and 16*a*, respectively, for receiving a generally U-shaped latch camming slide 28, as described below. As best illustrated in FIG. 6, the first and second elongated slots 14 and 16 lie in a first imaginary plane 60 and a second imaginary plane 62, respectively. In the embodiment being described, the first and second imaginary planes 60 and 62 are generally parallel. Each of the first and second elongated slots 14 and 16 (FIGS. 1 and 2) comprise a first locating opening 40 and a second locating opening 42. The function of the first and second elongated slots 14 and 16 and locating openings 40 and 42 will be described later herein. As shown in FIGS. 1, 2, 3 and 7, housing 12 comprises a wall 18 defining an aperture 20 for receiving a locking insert 22 (FIGS. 1 and 4).

Figure 7:
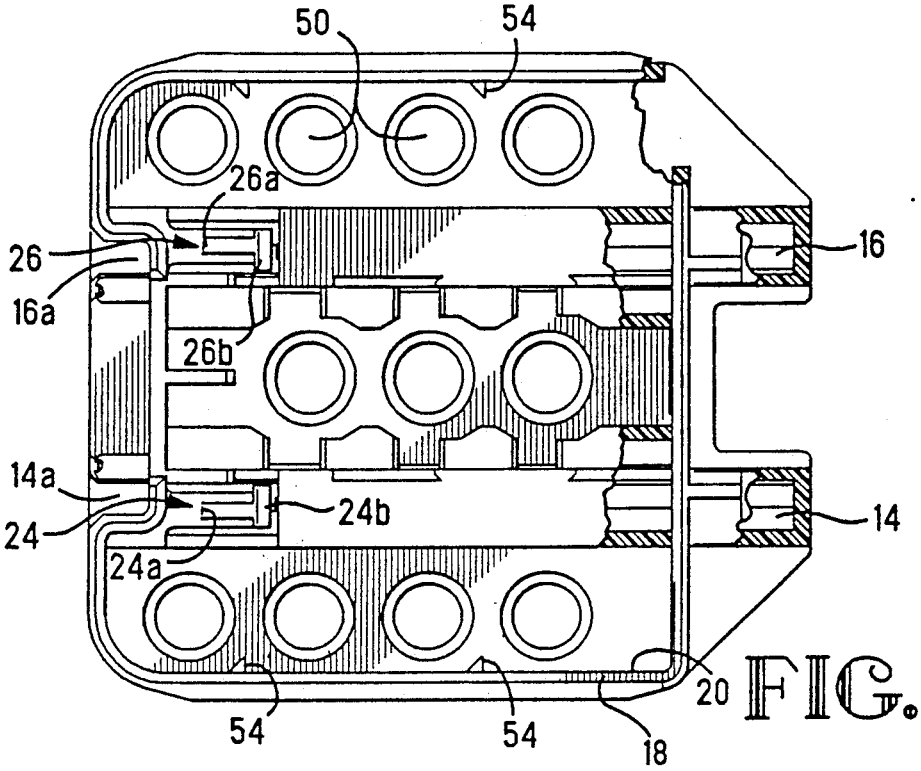
FIG. 7 is a view similar to that of FIG. 5, showing the housing in partial section and also showing the relationship of a first resilient latch and a second resilient latch to the first and second elongated slots, respectively.

As best illustrated in FIG. 7, housing 12 also comprises a first resilient latch 24 and a second resilient latch 26 which are associated with the first and second elongated slots 14 and 16, respectively. The first and second resilient latches 24 and 26 are normally biased towards aperture 20, as illustrated by the position of resilient latch 24 in FIG. 3. When locking insert 22 is mounted in aperture 20, it deflects resilient latch 24 into first elongated slot 14, as shown in phantom in FIGS. 1 and 2. As best illustrated in FIGS. 3 and 7, first resilient latch 24 comprises a first end 24*a* which is integrally formed into housing 12 and a second end 24*b* which is generally triangular in cross-section and which can be deflected as shown in phantom in FIGS. 1 and 2. The second resilient latch 26 comprises a first end 26*a* and a second end 26*b*, and it operates in the same manner as first resilient latch 24. The first and second resilient latches 24 and 26 are positioned towards the insert ends 14*a* and 16*a*, as shown in FIG. 7. In the embodiment being described, housing 12 is a one-piece construction molded from plastic.

Figure 2:
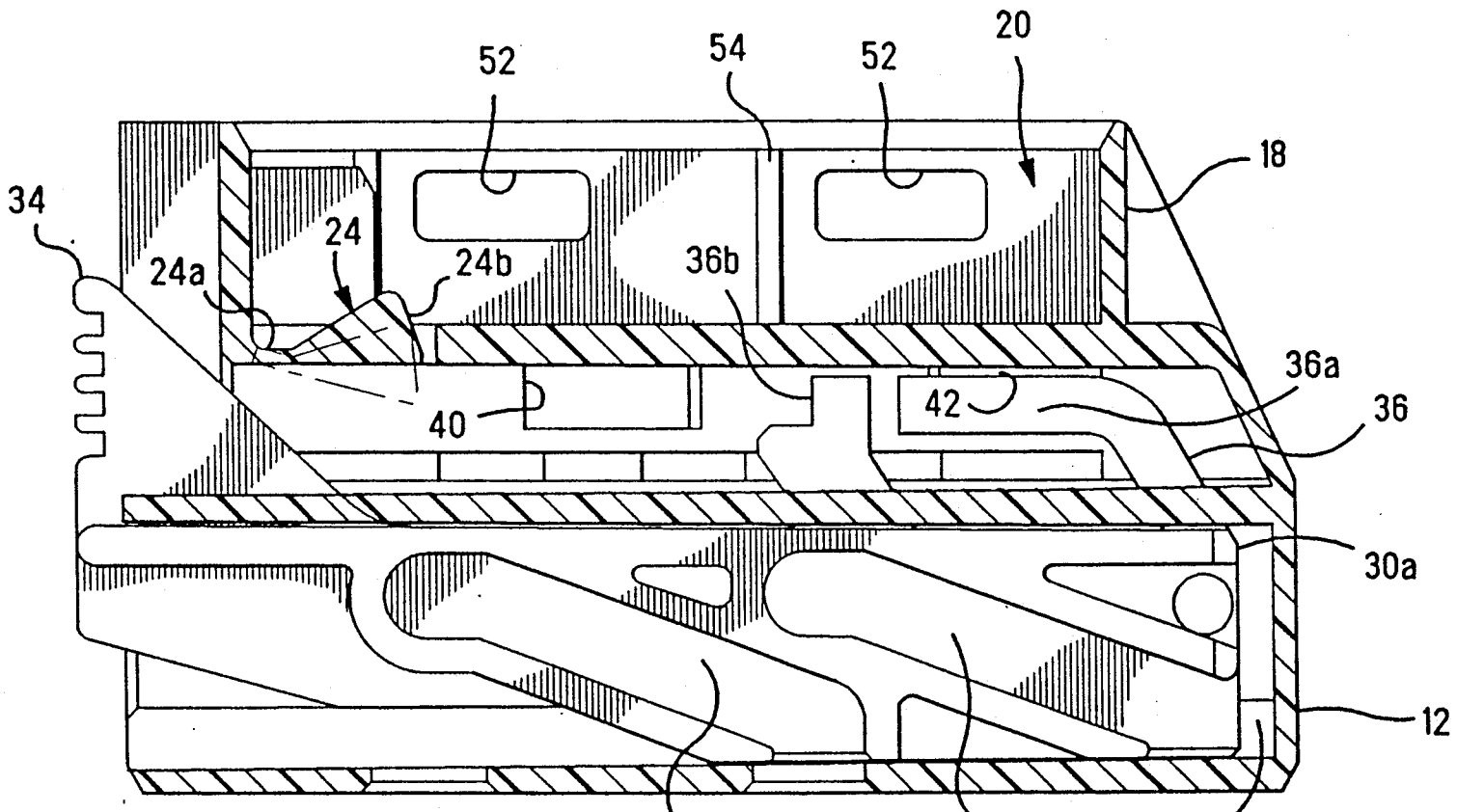
FIG. 2 shows the electrical connector with the camming slide in a camming position in the connector housing and the resilient latch shown in its normal upright biased position prior to mounting the locking insert onto the housing.
Figure 8:
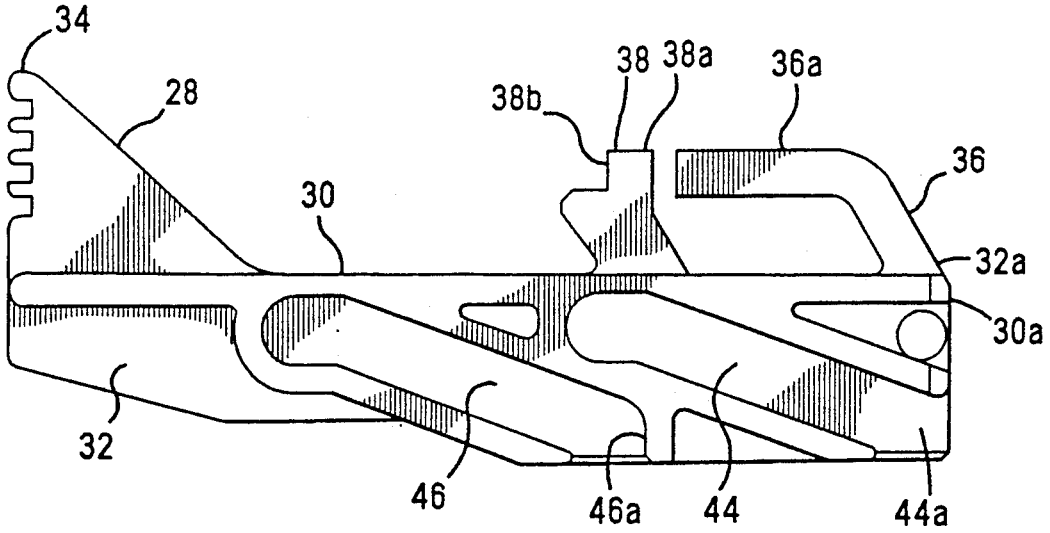
FIG. 8 is a side view of the camming slide.

The electrical connector 10 also comprises the generally U-shaped latch camming slide 28 (FIGS. 1, 2, and 8). As best shown in FIG. 8, latch camming slide 28 comprises a first leg portion 30, a second leg portion 32, and a joining portion 34 joining the first and second leg portions 30 and 32. The first leg portion 30 comprises a first resilient detent 36 having a wall 36*a*, and the second leg portion 32 comprises a second resilient detent 38 having a wall 38*a*. The first and second leg portions 30 and 32 comprise ends 30*a* and 32*a* which are guided into the first and second elongated slots 14 and 16, respectively, when it is desired to slidably mount the latch camming slide 28 into housing 12. The first and second resilient detents 36 and 38 each have a locator guide (not shown) on walls 36*a* and 38*b*. The locator guides cooperate with the first and second locating openings 40 and 42 (FIGS. 1 and 2) in order to locate the generally U-shaped latch camming slide 28 in an uncammed position (shown in FIG. 1) or a cammed position (shown in FIG. 2). As best shown in phantom in FIGS. 1 and 2, the first and second resilient detents 36 and 38 on latch camming slide 28 comprise a shoulder notch 36*b* and 38*b*, respectively. The shoulder notches 36*a* and 36*b* cooperate with the first and second resilient latches 24 and 26, respectively, to prevent the latch camming slide 28 from being retracted or removed from housing 12, as described below.

The first and second leg portions 30 and 32 have a pair of camming slots 44 and 46 which are capable of receiving a camming post (not shown) from a mating connector (not shown) so that the mating connector can be "cammed" into operative engagement with the electrical connector 10. The function, structure and concept of operation of the latch camming slide 28 is substantially similar to that disclosed in German Patent No. DE 3645179 C2, issued to Klunker et al., which is incorporated herein by reference and made a part hereof.

Figure 5:
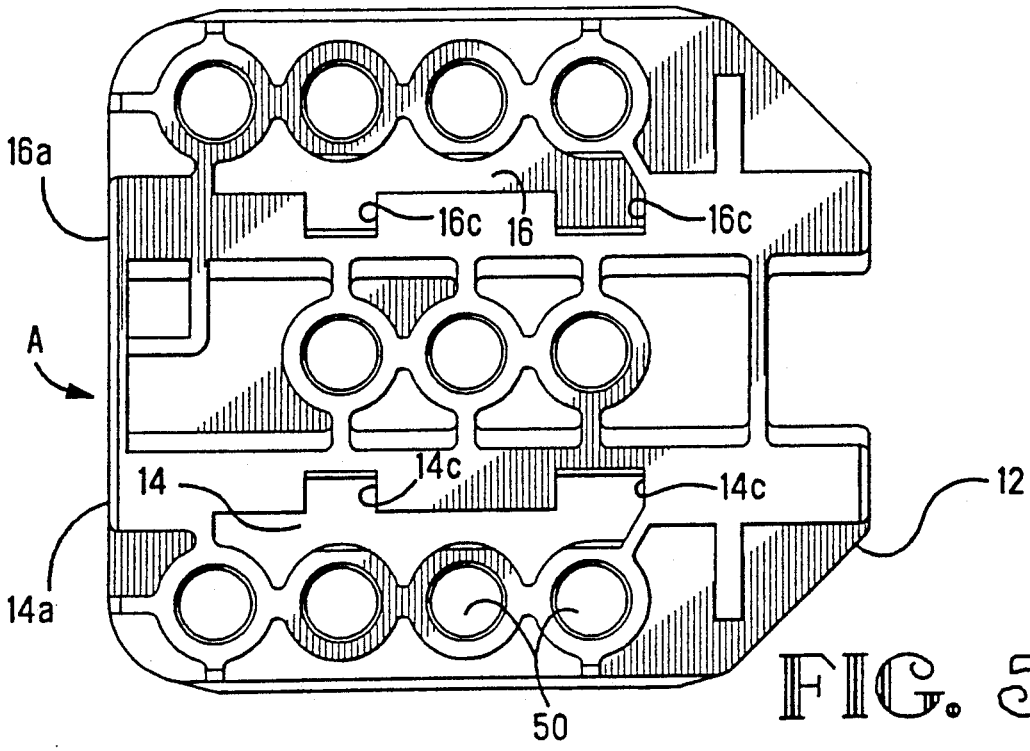
FIG. 5 is a top plan view of the connector housing shown in FIG. 1.

Referring now to FIGS. 1, 4 and 5, the electrical connector 10 also comprises locking insert 22 which is generally rectangular in shape and comprises a plurality of terminal openings 48. The terminal openings 48 become operatively aligned with housing openings 50 (FIG. 5) in housing 12 when locking insert 22 is mounted in aperture 20. The locking insert 22 comprises a bottom edge 22*a* (FIG. 1) which deflects or biases the first and second resilient latches 24 and 26 from their normal unbiased position (FIG. 3) to a biased position (shown in phantom in FIGS. 1 and 2), so that they become deflected into the first and second elongated slots 14 and 16, respectively. The locking insert 22 also comprises a plurality of locking detents 51 (FIG. 4) which cooperate with a plurality of openings 52 (FIG. 2) in wall 18 to lock locking insert 22 into opening 20.

As best shown in FIGS. 3 and 4, housing 12 comprises a plurality of barbs 54 (FIG. 7) which cooperate with a second plurality of barbs 56 located on locking insert 22 in order to align and lock locking insert 22 in aperture 20 of housing 12 so that the plurality of terminal openings 48 (FIG. 4) become operatively aligned with openings 50 (FIG. 7). The locking insert 22 is then slid in the direction of arrow C in FIG. 1 to lock locking insert 22 in opening 20. The locking slide concept described herein is substantially the same as is taught in European Patent specification EP 0 216 784 which is incorporated herein by reference and made a part hereof. In the embodiment being described, locking insert 22 is a one-piece construction molded from plastic.

The operation of the electrical connector 10 will now be described. The generally U-shaped latch camming slide 28 is slidably mounted in the housing by guiding the ends 30*a* and 32*a* (FIG. 8) of first and second leg portions 30 and 32, respectively, into insert ends 14*a* and 16*a* (FIG. 6) of the first and second elongated slots 14 and 16, respectively. Notice that, because the first and second resilient latches 24 and 26 are normally biased away from the first and second elongated slots 14 and 16, respectively, the latch camming slide 28 can be easily mounted and dismounted from housing 12. When it is desired to lock latch camming slide 28 in housing 12, the latch camming slide 28 is inserted into the first and second elongated slots 14 and 16 until the shoulder notches 36*b* and 38*b* pass the first and second resilient latches 24 and 26, respectively. The locking insert 22 is positioned above opening 20 (as viewed in FIG. 2). The locking insert 22 is then positioned or forced into opening 20 until the plurality of locking detents 51 "snap" or lock into the plurality of openings 50. As locking insert 22 is positioned or forced into aperture 20 of housing 12, the bottom edge 22*a* (FIG. 1) of locking insert 22 causes first and second resilient latches 24 and 26 to be deflected into the first and second elongated slots 14 and 16, respectively, in the manner described earlier herein. Advantageously then, as latch camming slide 28 is retracted or moved in the direction of arrow B in FIG. 1, shoulder notches 36*b* and 38*b*, engage first and second resilient latches 24 and 26, respectively, thereby preventing the latch camming slide 28 from being pulled completely out of housing 12. To remove latch camming slide 28 from housing 12, locking insert 22 is removed from opening 22, thereby enabling the first and second resilient latches 24 and 26 to return to their non-deflected position. Thereafter, latch camming slide 28 may be slidably removed from housing 12.

Various changes or modification in the invention may occur to those skilled in the art without departing from the spirit or scope of the invention. The above description of the invention is intended to be illustrative and not limiting and it is not intended that the invention be restricted thereto but that it be limited only by the true spirit and scope of the appended claims.

We claim:

1. A connector comprising a housing comprising a first elongated slot and a second elongated slot, said housing also comprising a wall defining an aperture, a first resilient latch associated with said first elongated slot and said aperture, and a second resilient latch associated with said second elongated slot and said aperture;

a generally U-shaped latch camming slide having a first leg portion, a second leg portion and a joining portion joining said first and second leg portions, said first and second leg portions being received in said first and second elongated slots, respectively, so that said generally U-shaped latch camming slide can slide in and out of said housing, each of said first and second resilient detents having a shoulder notch; and a locking insert for mounting in said aperture in order to bias said first and second resilient latches into said first and second elongated slots so that said shoulder notches of said first and second resilient detents engage said first and second resilient latches, respectively, thereby locking said generally U-shaped latch camming slide in said housing.

2. The connector of claim 1, wherein each of said first and second elongated slots comprise a first locating opening and a second locating opening;

said first and second leg portions comprising a first resilient detent and a second resilient detent, respectively, said first and second resilient detents each comprising a locator guide for cooperating with said first and second locating openings in order to locate said generally U-shaped latch camming slide in an uncammed position or a cammed position, respectively.

3. The connector of of claim 1, wherein said wall has a plurality of aligning barbs and said locking insert comprises a second plurality of aligning barbs, said second plurality of aligning barbs cooperating with said plurality of aligning barbs to align and slidably lock said locking insert in said aperture when said locking insert is received in said aperture.

4. The connector of any of claim 1, wherein said wall comprises a plurality of openings, said locking insert comprising a plurality of locking detents which cooperate with said plurality of openings to lock said locking insert in said aperture of said housing.

5. The connector of claim 1, wherein said first and second leg portions each comprise a plurality of camming slots, each of said plurality of camming slots being capable of receiving a camming post from a mating connector so that said mating connector can be cammed into operative engagement with said connector when said generally U-shaped latch camming slide is moved into a cammed position in said housing.

6. The connector of claim 1, wherein said housing and said locking insert are each a one-piece construction molded from plastic.

7. The connector of claim 1, wherein each of said first and second resilient latches comprise a first end integrally formed as part of said housing and a second end which is generally triangular in cross-section, said second end being biased into said first or second elongated slot when said locking insert is mounted in said aperture.

8. The connector of claim 1, wherein said first and second elongated slots lie in a first imaginary plane and a second imaginary plane, respectively, said first and second imaginary plane being generally parallel.

9. The connector of claim 1, wherein said connector is assembled in accordance with the method comprising the steps of:

(a) inserting said first and second leg portions at said latch camming slide into said first and second elongated slots until said shoulder notches pass said first and second resilient detents; and (b) inserting said locking insert in said opening and thereby causing said first and second resilient latches to be deflected into said first and second elongated slots, respectively, thereby locking said locking insert in said housing.

10. The connector of claim 9, wherein said method further comprises the step of:

(c) camming a mating connector into engagement with said connector by sliding said latch camming slide from an uncammed position to a cammed position.

11. A connector comprising a housing comprising a first elongated slot and a second elongated slot, said housing also comprising a wall defining an aperture, a generally U-shaped latch camming slide having a first leg portion, a second leg portion and a joining portion joining said first and second leg portions, said first and second leg portions being received in said first and second elongated slots, respectively, so that said generally U-shaped latch camming slide can slide in and out of said housing, and a locking insert for mounting in said aperture said connector being characterized in that a first resilient latch is associated with said first elongated slot and said aperture, and a second resilient latch is associated with said second elongated slot and said aperture, each of said first and second resilient detents having a shoulder notch and said locking insert is movable in order to bias said first and second resilient latches into said first and second elongated slots so that said shoulder notches of said first and second resilient detents engage said first and second resilient latches, respectively, thereby locking said generally U-shaped latch camming slide in said housing.

* * * * *